United States Patent [19]

Presnall, Jr. et al.

[11] 4,257,491

[45] Mar. 24, 1981

[54] SCAFFOLD APPARATUS

[75] Inventors: Homer H. Presnall, Jr.; Earl G. Cutler, both of San Antonio, Tex.

[73] Assignee: Prescon Corporation, San Antonio, Tex.

[21] Appl. No.: 7,417

[22] Filed: Jan. 29, 1979

[51] Int. Cl.[3] ..... E04G 3/12; E04G 3/10; E04G 3/16

[52] U.S. Cl. ..... 182/142; 182/2; 182/187; 187/6

[58] Field of Search ..... 182/142, 143, 145, 45, 182/187, 128; 187/6

[56] References Cited

U.S. PATENT DOCUMENTS

| | | | |
|---|---|---|---|
| 3,095,060 | 6/1963 | Reinhardt | 182/142 |
| 4,132,287 | 1/1979 | Parolini | 182/45 |

*Primary Examiner*—Reinaldo P. Machado
*Attorney, Agent, or Firm*—David Alan Rose; Ned L. Conley; Murray Robinson

[57] ABSTRACT

An enclosed scaffold is suspended from a plurality of wire lines attached near the apex of a hemispheric dome surmounting the cylindrical sides of a containment structure, e.g. a tank. The scaffold is attached to the wire lines by hydraulically actuated cable gripping and climbing devices which may be manually or automatically controlled to raise and lower the scaffold. A wheel mounted car rides on the face of a buttress on the exterior of the containment structure wall. A boom mounted on the car is pivotally attached to the top of the scaffold. By means of a hydraulic thruster mounted on the car, the points of attachment of the scaffold to the boom can be moved away from or toward the buttress and wall as needed to provide room for the scaffold to hang level when it moves over the curved part of the structure. To balance torques on the scaffold tending to keep it from hanging level, guide channels carried by the lower part of the car engage rollers carried by the lower part of the scaffold, the roller position with respect to the guide channels being adjustable by screw jacks. The radial component of the force exerted on the scaffold by the wire lines keeps the car wheels in positive engagement with the buttress at all points above the springline. Below the springline, guide rails temporarily bolted to the buttress hold the car wheels against the buttress, thereby to maintain the scaffold level. The scaffold may be adapted to different buttress configurations and may be adapted to receive and suspend pup scaffolds for operating over the vertical part of the structure wall.

18 Claims, 27 Drawing Figures

31
51
53
69
41
59
39
45
63
67
59
97
43
91
69

SCAFFOLD APPARATUS

BACKGROUND OF THE INVENTION

1. Field of the Invention

This invention relates to scaffolds and more particularly to self-raising scaffolds.

2. Background of the Prior Art

Conventional scaffolding has proven ineffective and very expensive for use on containment structures having cylindrical sides and a hemispherical roof. Such structures are being used to house nuclear reactors, and include a reinforced concrete structure consisting of a vertical cylinder, a hemispherical dome, and a flat foundation mat. For safety purposes containment structures for nuclear reactors are prestressed by a post-tensioning system and have a portion thereof below ground level. Vertical concrete buttresses are provided for anchoring horizontal tendons in the cylinder walls and part of the dome section. Scaffolding is utilized to provide access to the buttresses and install the tendons to prestress the structure.

It is known to suspend a scaffold from lines connected to the top of a vertical walled building and to raise and lower the scaffold by means of line grippers and climbers. It is also known to provide a scaffold with a plurality of long rollers whose axes lie in a plane inclined to the scaffold floor, whereby the scaffold can be operated over an inclined roof or wall. Neither of these systems is satisfactory for a dome shaped structure since the attitude of the wall of a dome changes from vertical to horizontal as one progresses from the springline to the apex of the dome.

SUMMARY OF THE INVENTION

According to the invention, a scaffold is suspended from a plurality of flexible wire lines connected to the top of a domed structure. The scaffold is connected to the lines by line climbers. A wheeled car is adapted to ride along an exterior buttress of the dome. The top of the scaffold is pivotally connected to a boom mounted on the car. The boom suspends the top of the car away from the dome to leave room for the scaffold to hang level. The point on the boom to which the top of the scaffold is connected is varied according to the attitude of the wall of the dome at the level of the scaffold. This is accomplished by means of a hydraulic thruster mounted on the car.

If the boom is pivotally connected to the scaffold at an axis farther from the dome axis than the axis passing through the points of connection of the lines to the scaffold, as is preferred, there is created a torque tending to swing the bottom of the scaffold closer to the dome. The center of gravity of the loaded scaffold depends upon the location of the loads it is carrying and may create a similar or opposite torque. To keep the lower end of the scaffold from moving under such torques, the lower part of the car is provided with guide channels engaging guide rollers carried by the scaffold. The guide channels are shaped to keep the scaffold vertical as the thruster moves the top of the scaffold away from or toward the dome. Screw jacks on the scaffold adjust the position of the guide rollers as may be required.

The car is provided at each side with outrigger guide rollers engageable with the sides of the buttress to keep the car and scaffold from moving sideways when the scaffold is operating above and below the springline.

The radial component of the rope tension at this time, acting through the scaffold and thruster, keeps the car wheels in contact with the face of the buttress and the guide rollers in contact with the sides of the buttress. This enables the buttress to guide the car, and through it the scaffold, in the up and down travel of the scaffold. This also enables reaction torque to be transferred from the buttress to the car to enable the car to exert the necessary leveling torque on the scaffold.

When operating below the springline, the car also engages guides which are removably bolted to the sides of the buttress. The stabilizer rollers, mounted on the car and engaging the guides on the buttress, keep the car wheels against the buttress so the car can exert the necessary torque to keep the scaffold level. These rollers also keep the car from moving sideways as its wheels roll up and down the face of the buttress below the springline.

In a modification, the scaffold includes a main scaffold or docking module operated like the scaffold in the first embodiment. Pup scaffolds carried in the main scaffold may be removed therefrom and suspended from the main scaffold by slings and then operated up and down on each side of the vertical part of the buttress by raising and lowering the main scaffold. This makes it possible to operate below floor level when the vertical side of the structure extends below floor level, the pup scaffolds being lowered through holes, like elevator shafts, in the roofs of structures adjacent the containment structure. The pup scaffolds are docked in the main scaffold when the latter is operated up and down over the dome and when there is no obstacle to the main scaffold operating up and down over the vertical part of the structure wall.

Protection wheels engaging the structure wall are carried by the scaffold at floor level to keep the scaffold from contacting with the dome and to protect the face of the dome from abrasion by the scaffold.

BRIEF DESCRIPTION OF THE DRAWINGS

For a detailed description of preferred embodiments of the invention, reference will now be made to the accompanying drawings wherein—

The drawings are to scale. Except as otherwise indicated the parts are made of hard, rigid, strong metal, namely steel.

DESCRIPTION OF PREFERRED EMBODIMENTS

Figures 1, 1A:
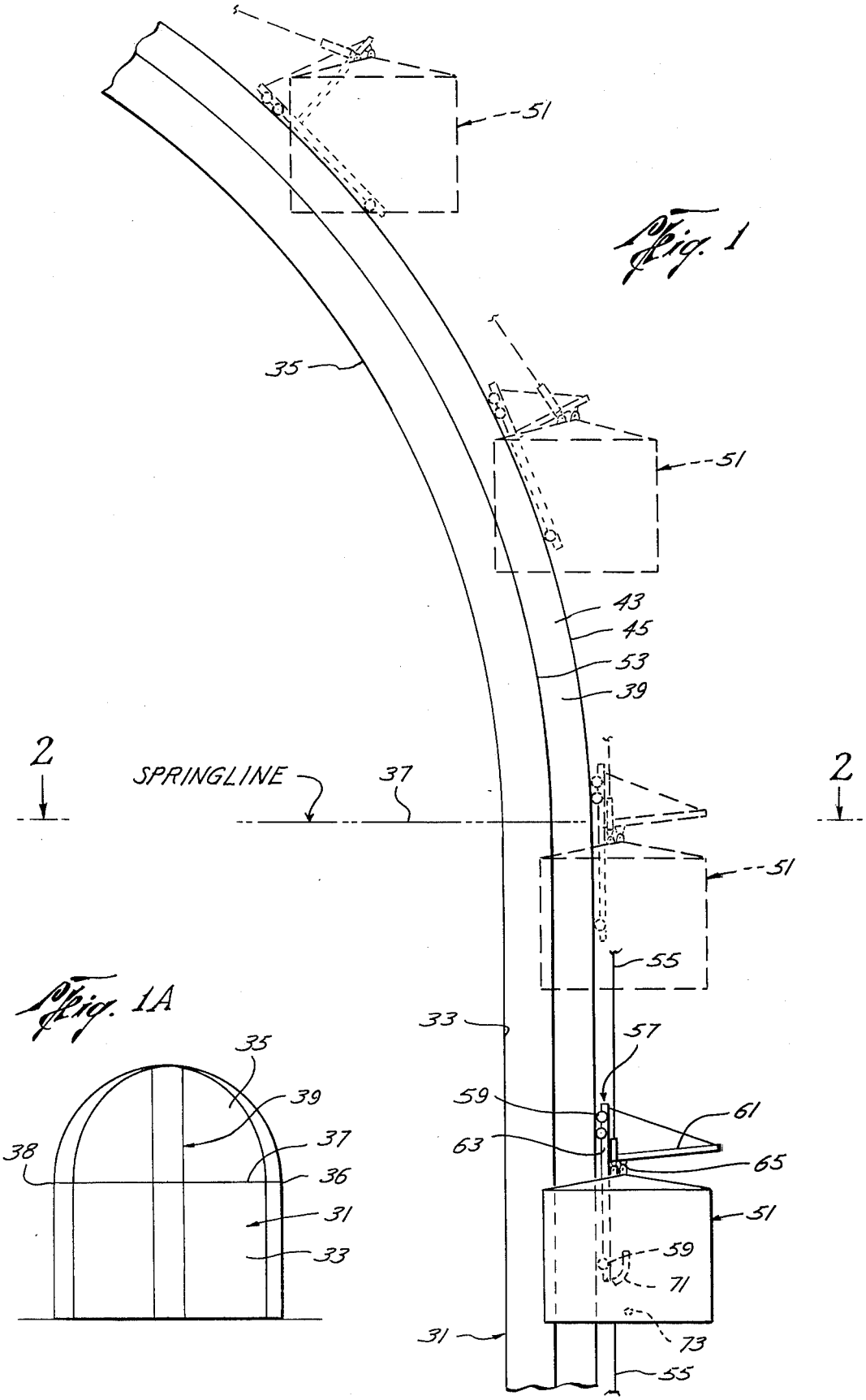
FIG. 1 is a schematic elevational view of a containment structure, such as shown in FIG. 1A, having cylindrical sides and a hemispherical dome and showing a scaffolding system embodying the invention deployed thereon, four different positions of the same scaffold being shown.
FIG. 1A is an elevation view of a typical containment structure.

Referring to FIGS. 1 and 1A there is shown a containment structure or tank 31 having cylindrical sides 33 and a hemispherical roof or dome 35 above the springline 37. The springline 37 is an imaginary line connecting two opposite points at which the curve of the arch or dome begins, e.g. an imaginary line starting at point 36 and extending across the diameter of the tank 31 to the point 38 opposite it. A portion of containment structure 31 may be disposed below ground level. On the convex side or exterior of the structure 31 and azimuthally spaced apart about the dome 35 are a plurality of buttresses such as the one shown at 39. Each buttress extends up vertically along the cylindrical side 33 of the structure 31 and then curves over to follow along dome 35. Shown best in FIG. 2, the sides 41, 43 of the buttress 39 converge toward face 45 of the buttress.

Figure 4:
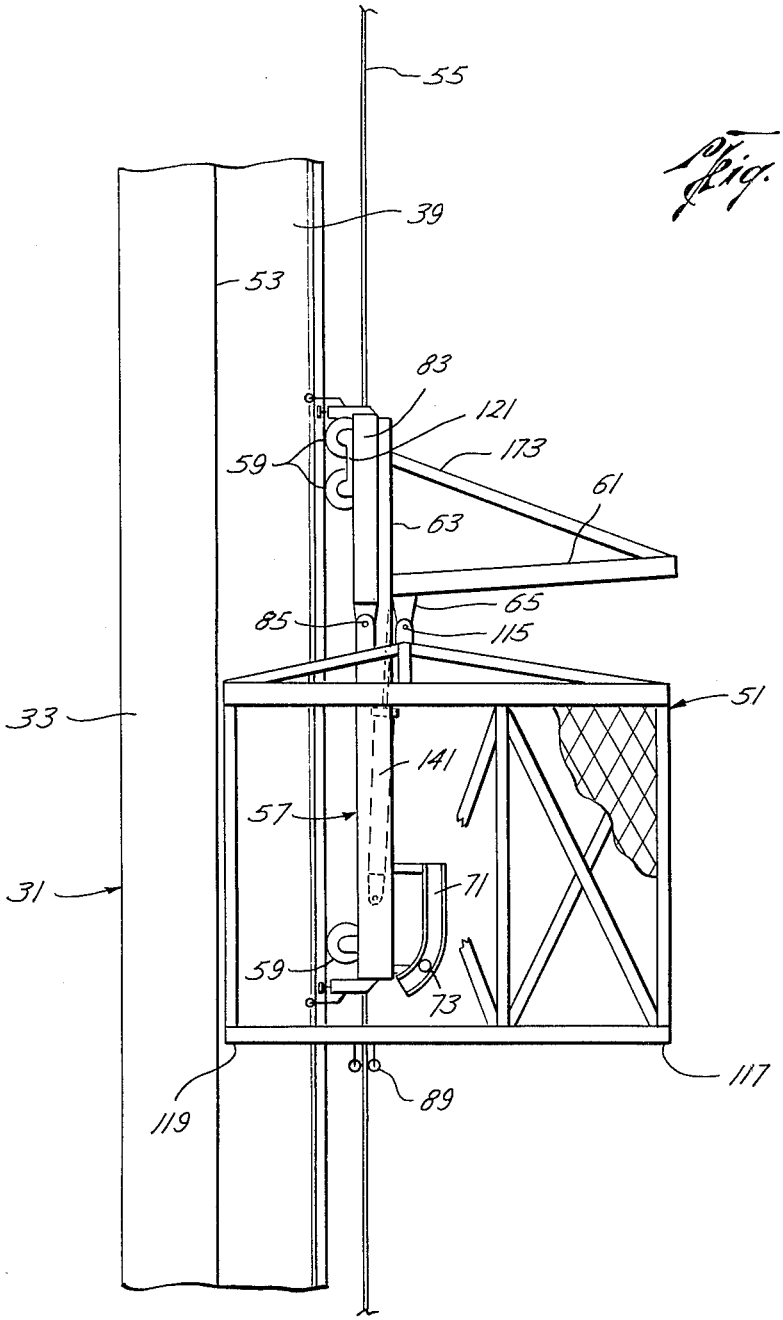
Figure 5:
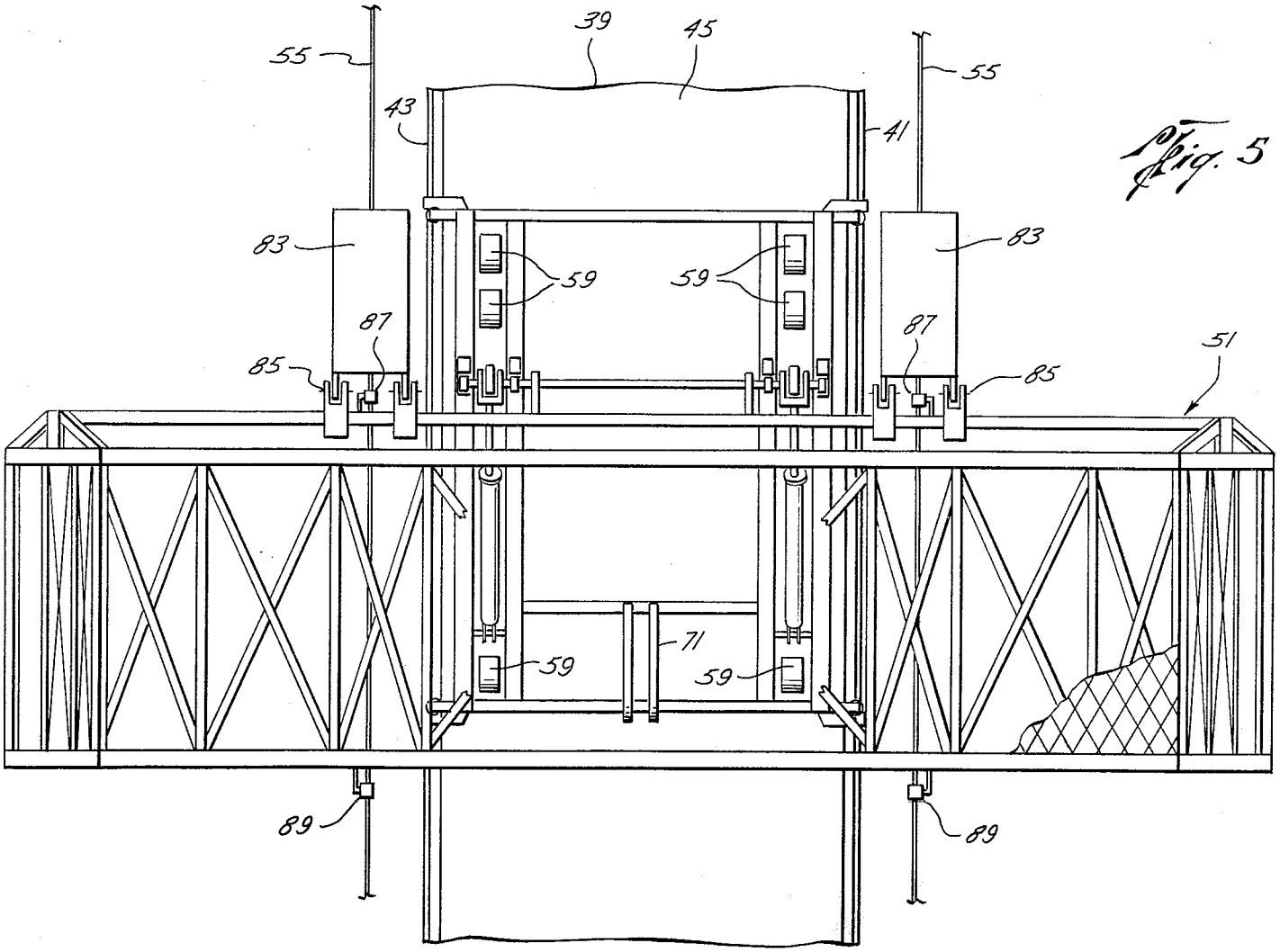
FIG. 5 is a front elevation of the scaffold and car of the system.

Referring now to FIG. 4, a scaffold 51 is suspended adjacent the exterior surface 53 of the containment structure 31 by means of a plurality of lines 55 connected to the upper end of the scaffold (see also FIG. 5). Lines 55 are typically wire ropes or similar flexible metal cables. The upper end of the scaffold 51 is positioned far enough from the sides 33 and dome 35 of structure 31, to permit it to hang level. This function is performed by means including a car 57 mounted on wheels 59 which roll over face 45 of buttress 39. A boom 61 extends transversely from the chassis 63 of the car 57 and over the top of the scaffold 51. A connector 65 carried by the boom 61 is pivotally connected to the top of the scaffold 51. Thrust or force means 141, 143 (see FIG. 14) carried by the car 57 moves the connector 65 in and out along that portion of boom 61 extending over scaffold 51 according to the elevation of the car 57 and scaffold 51 relative to the containment structure 31. Different relative positions are indicated on FIG. 1 by phantom showings of the car 57, the connector 65 being near side 33 of the containment structure 31 when car 57 is below the springline 37 and farther away as car 57 moves up the dome 35 toward the apex of the dome. A practical limit for operation of the scaffold 51 is at an elevation corresponding to an angle of forty-five degrees above springline 37.

Figure 2:
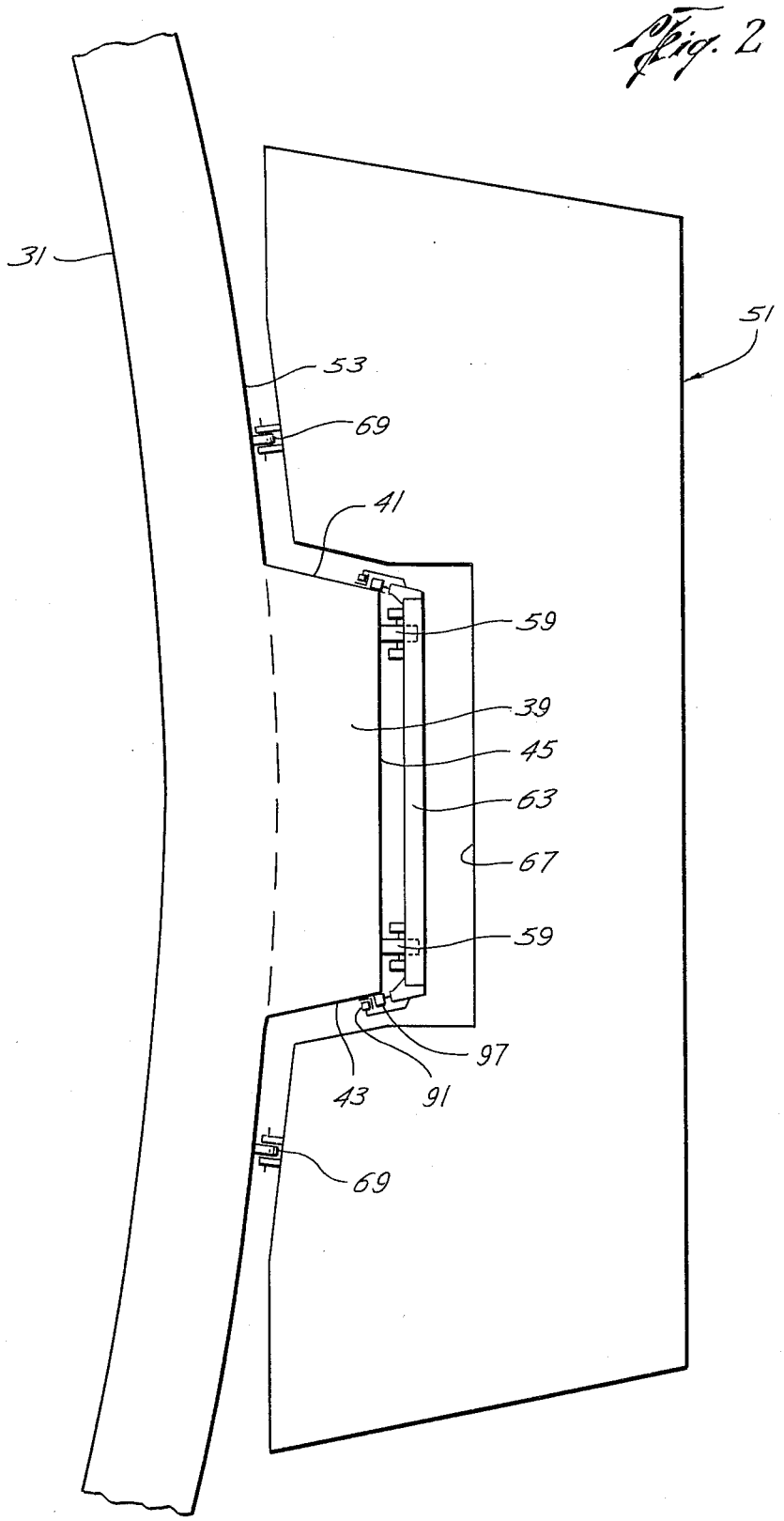
FIG. 2 is a horizontal section at the roof level, through the subject matter of FIG. 1, taken at the springline.
Figure 6:
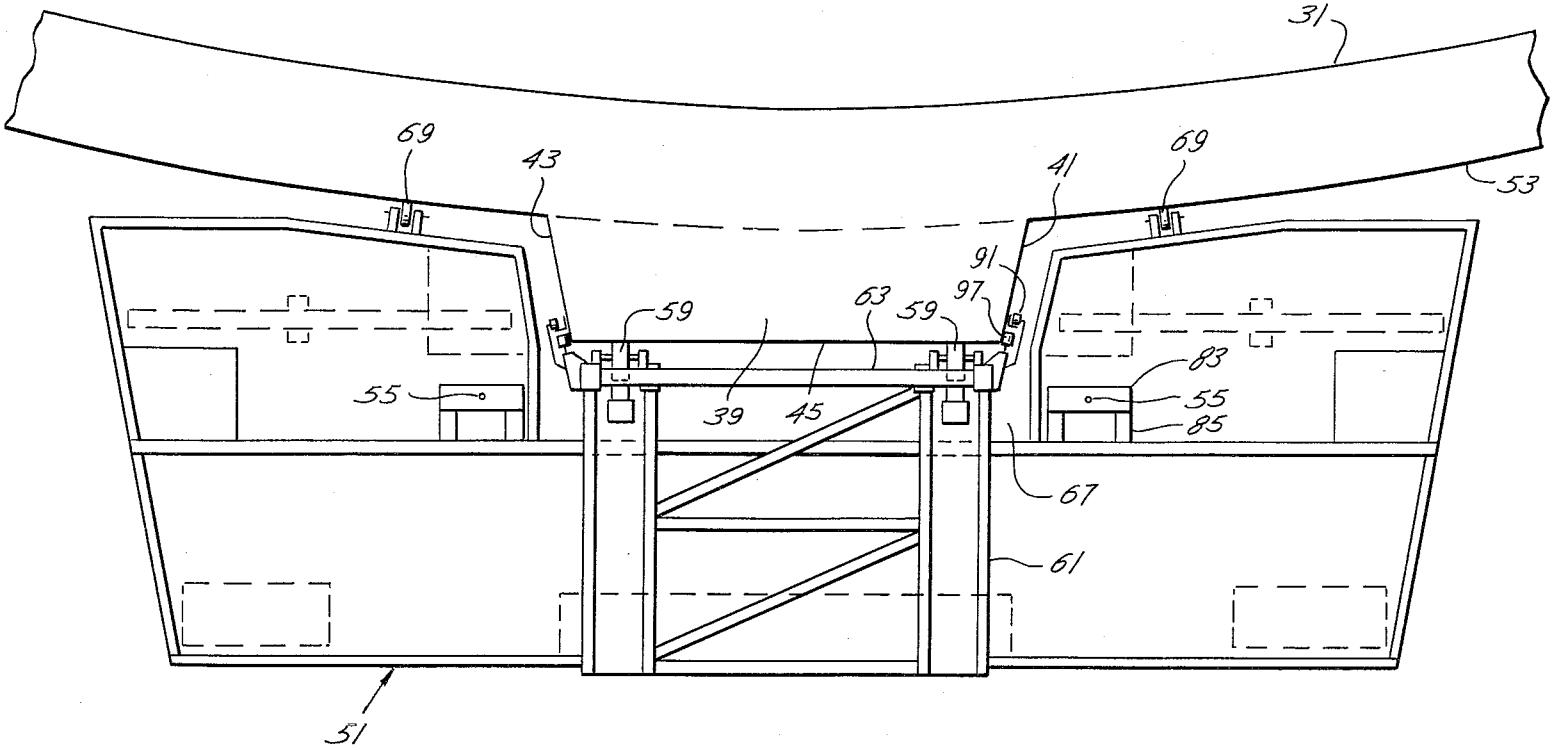
FIG. 6 is a plan view of the subject matter of FIG. 5.

As shown in FIGS. 2 and 6, the scaffold 51 has an inset 67 in its inner perimeter, adapting it to fit about buttress 39. Car chassis 63 is received within the inset 67 of scaffold 51 with rollers 59 engaging buttress face 45. Side wheels 69, mounted at the floor level on the lower part of scaffold 51, engage exterior surface 53 of the containment structure 31 to prevent scaffold 51 from scraping and abrading surface 53 and from twisting about a vertical axis.

Figure 11:
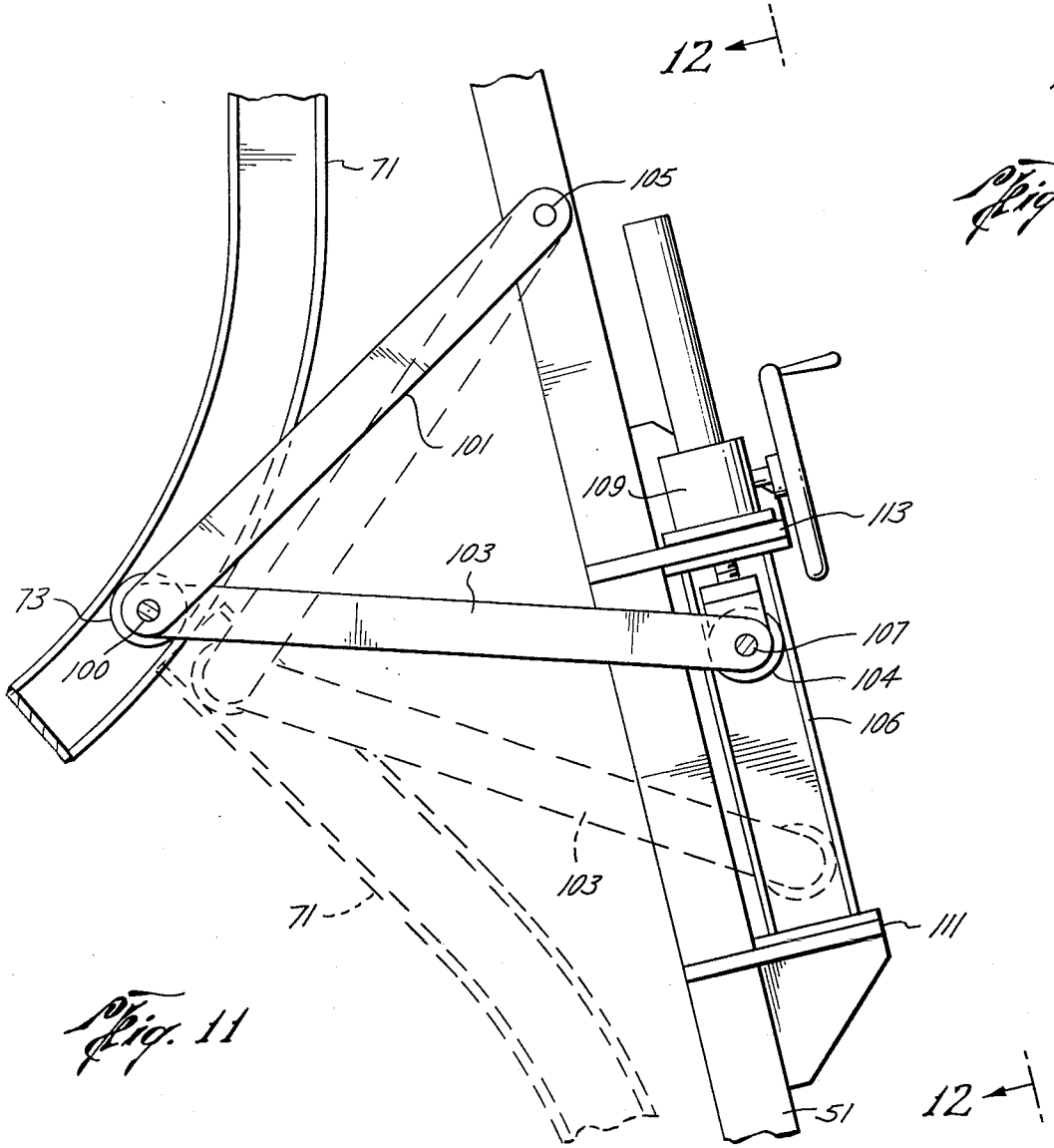
FIG. 11 is a fragmentary side view showing the leveling track and cooperating jack-adjustable rollers on the scaffold.

Referring once more to FIGS. 1 and 3, scaffold 51 is provided with leveling guide track means 71 in which moves rollers 73, shown in detail in FIG. 11, carried by the scaffold 51. This provides any counter torque required to cause the scaffold 51 to hang level due to the torque caused by lines 55. Car 57 is maintained against the face 45 of that portion of buttress 39 extending above springline 37 by the horizontal component force from lines 55 and against face 45 of that portion extending below springline 37 by guide rails 93 on buttress 39 and rollers 91 on car 57 described hereinafter with respect to FIGS. 8 and 9.

Figure 3:
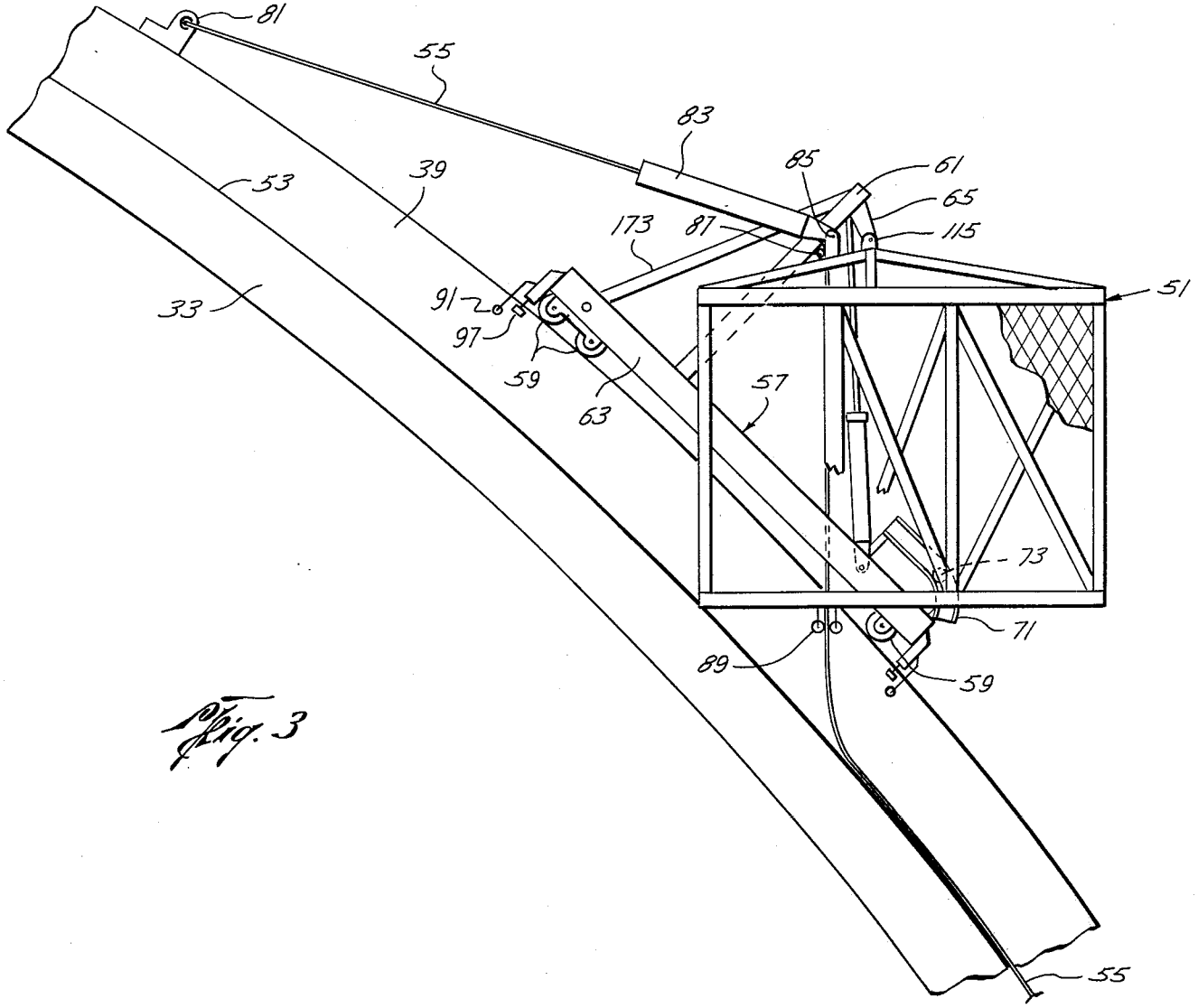
FIGS. 3 and 4 together form a view similar to FIG. 1 but to a larger scale permitting detail to be shown, the scaffold and car and other parts of the system being shown in side elevation.
Figure 7:
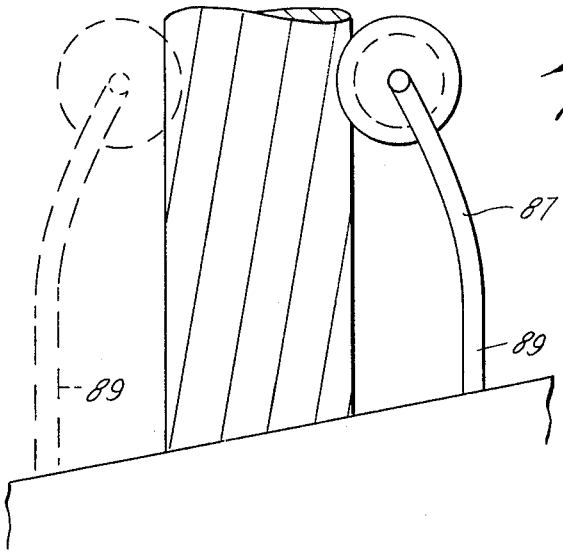
FIG. 7 is a side view of a cable guide used in the system.

Referring generally now to FIGS. 3 and 4, showing side elevation views at positions above and below springline 37, and to FIGS. 5 and 6, showing front and top views, there is shown in FIG. 3 anchor means 81 at the top of the dome 35 by means of which lines 55 are attached to the containment structure 31 to support the scaffold 51. The two lines 55, shown in FIG. 5, are attached to the scaffold 51 by means of conventional line grippers and climbers 83, e.g. those known as Luckers cable grippers and climbers. The lower ends of the climbers 83 are pivotally attached to the scaffold 51 at 85. The line ends below the grippers 83 are guided into and out of the enclosed scaffold 51 by means of guides 87, 89, shown generally in FIGS. 3 and 5 and in detail in FIG. 7. Guide 87 is mounted on the roof of scaffold 51 to deflect line 55 toward structure 31 and guides 89, constructed like guide 87 with one shown in broken lines, in FIG. 7, are mounted on the floor of scaffold 51 to deflect line 55 downwardly. Guides 87, 89 include a softner attached to a cable deflector plate and engaging lines 55.

Figure 8:
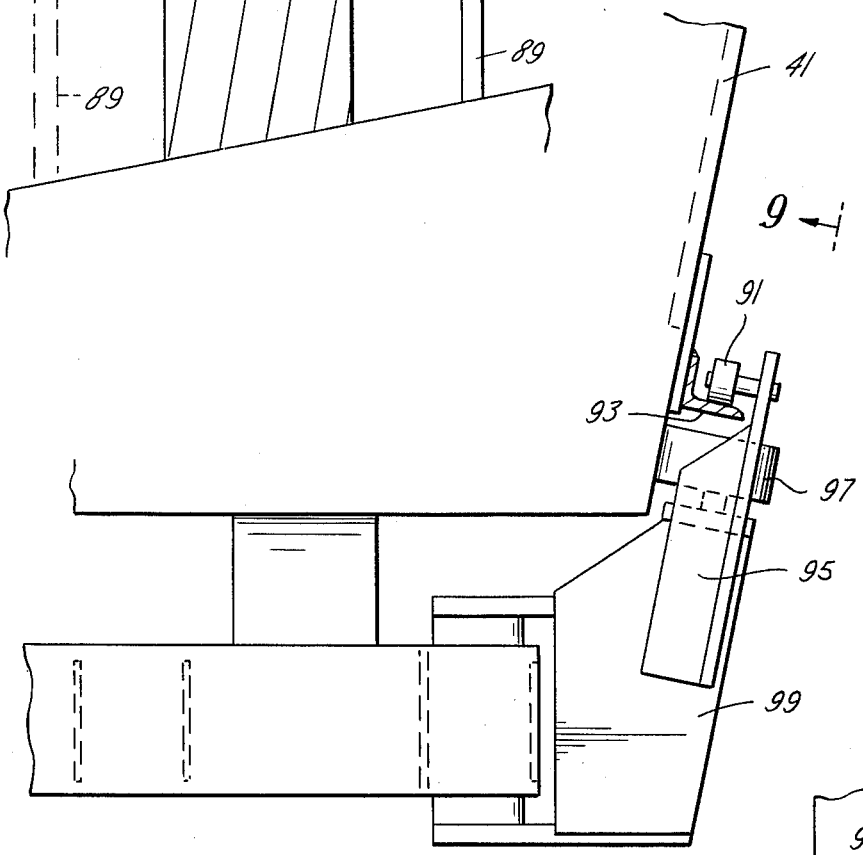
FIGS. 8 and 9 are fragmentary plan views of a portion of the car and buttress showing guide and stabilizer rollers.
Figure 9:
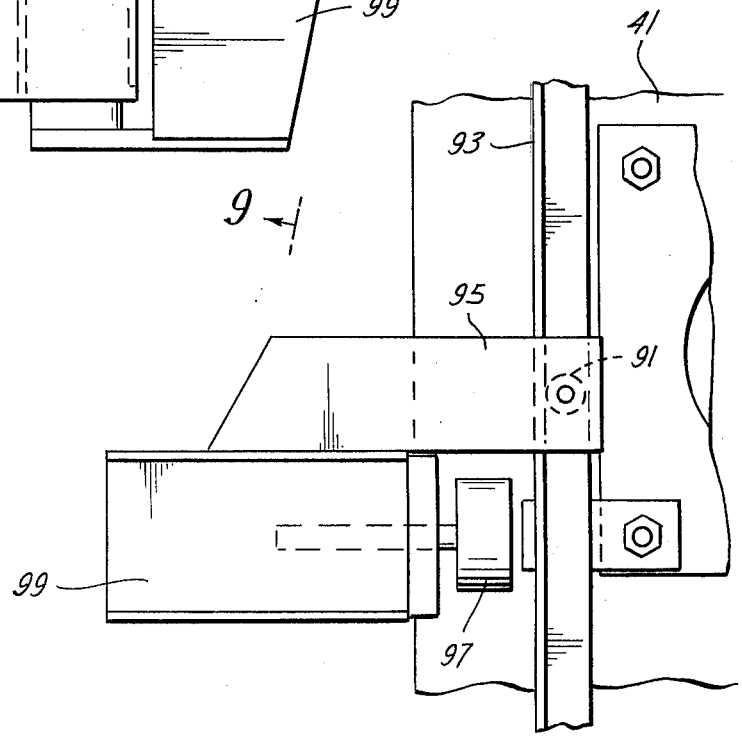

Outrigger guide rollers 91, shown generally in FIG. 6 and in detail in FIG. 8, mounted on bracket arms 95 of car chassis 63 engage guide rails 93 which are removably bolted to the sides 41, 43 of that portion of buttress 39 extending below springline 37. Rollers 91 engage that portion of guide rails 93, facing exterior surface 53 of structure 31, to guide car 57 along buttress 39 and to keep the wheels 59 of car 57 against face 45 of the buttress 39. Above the springline 37, the radial component of the tension from lines 55 holds the car wheels 59 against buttress face 45, and side guide rollers 97 (see FIG. 9) carried on brackets 99 connected to chassis 63 engage the sides 41, 43 of the buttress 39 to guide car 57 along buttress 39 and to prevent car 57 and scaffold 51 from twisting about a vertical axis and moving sideways when the scaffold is operating above the springline 37.

Figures 10, 10A:
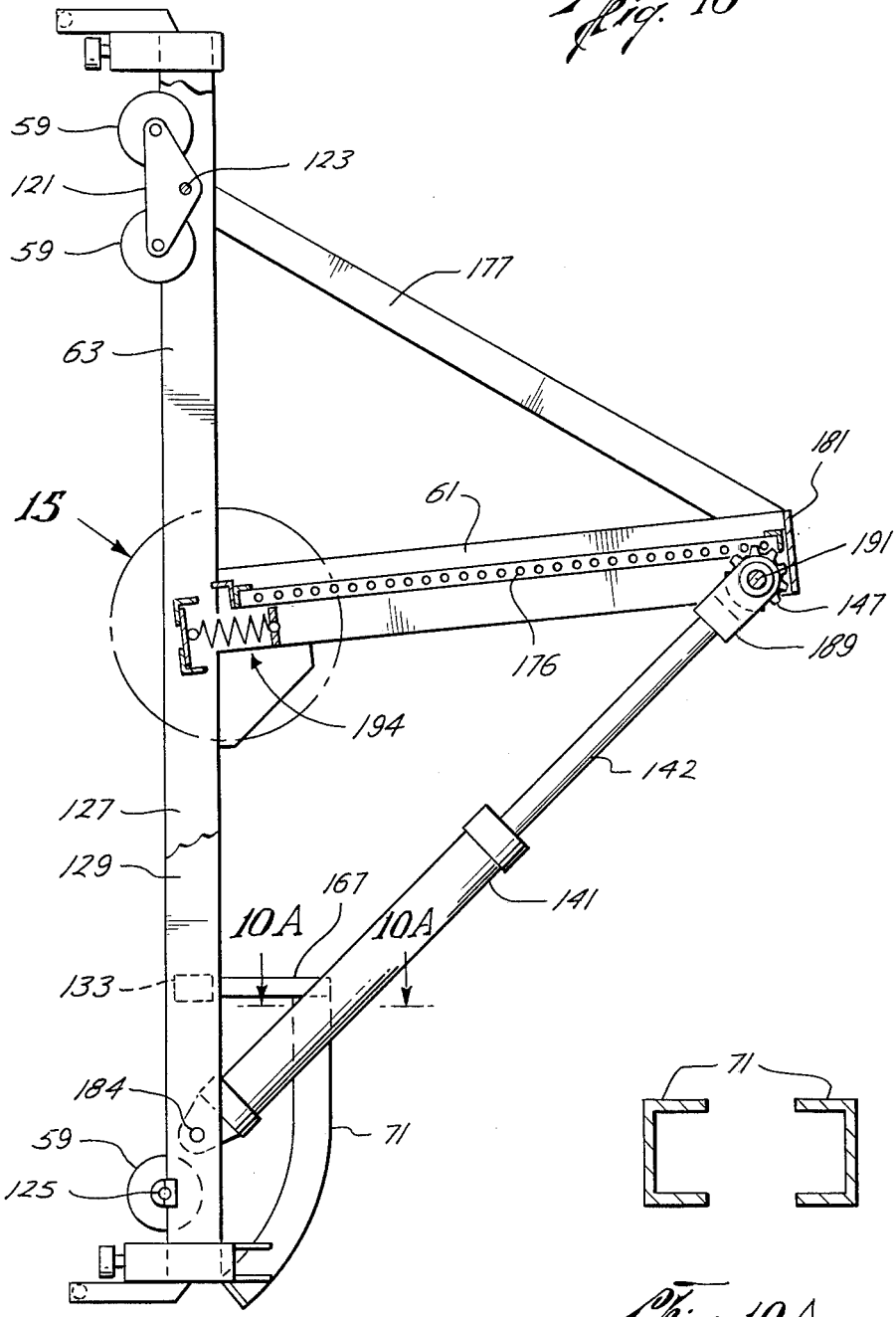
FIG. 10 is a side view of the car showing the wheeled chassis, the thruster boom, and the leveling track.
FIG. 10A is a section view of the leveling track taken at plane A—A indicated in FIG. 10.
Figure 12:
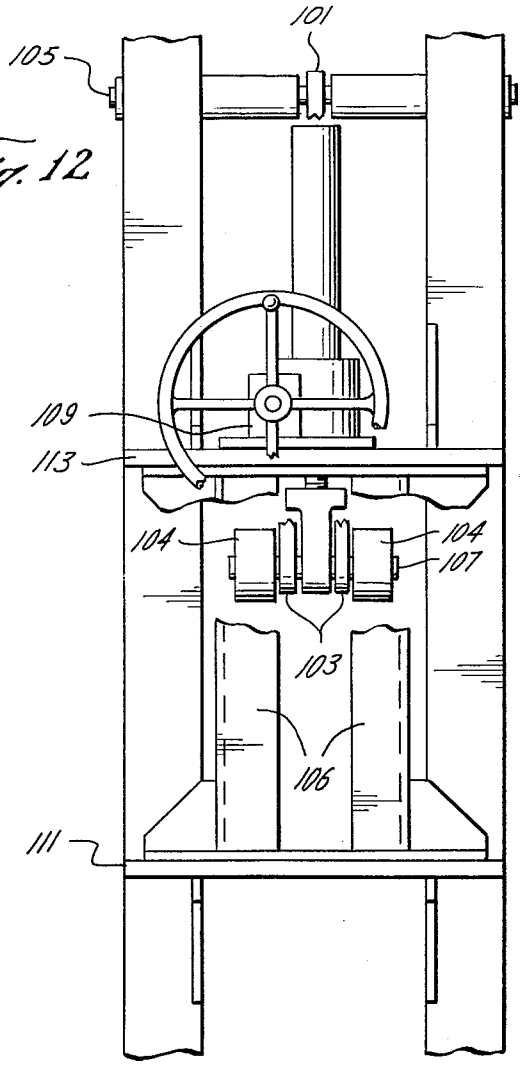
FIG. 12 is a view taken at 12—12 indicated in FIG. 11.
Figure 13:
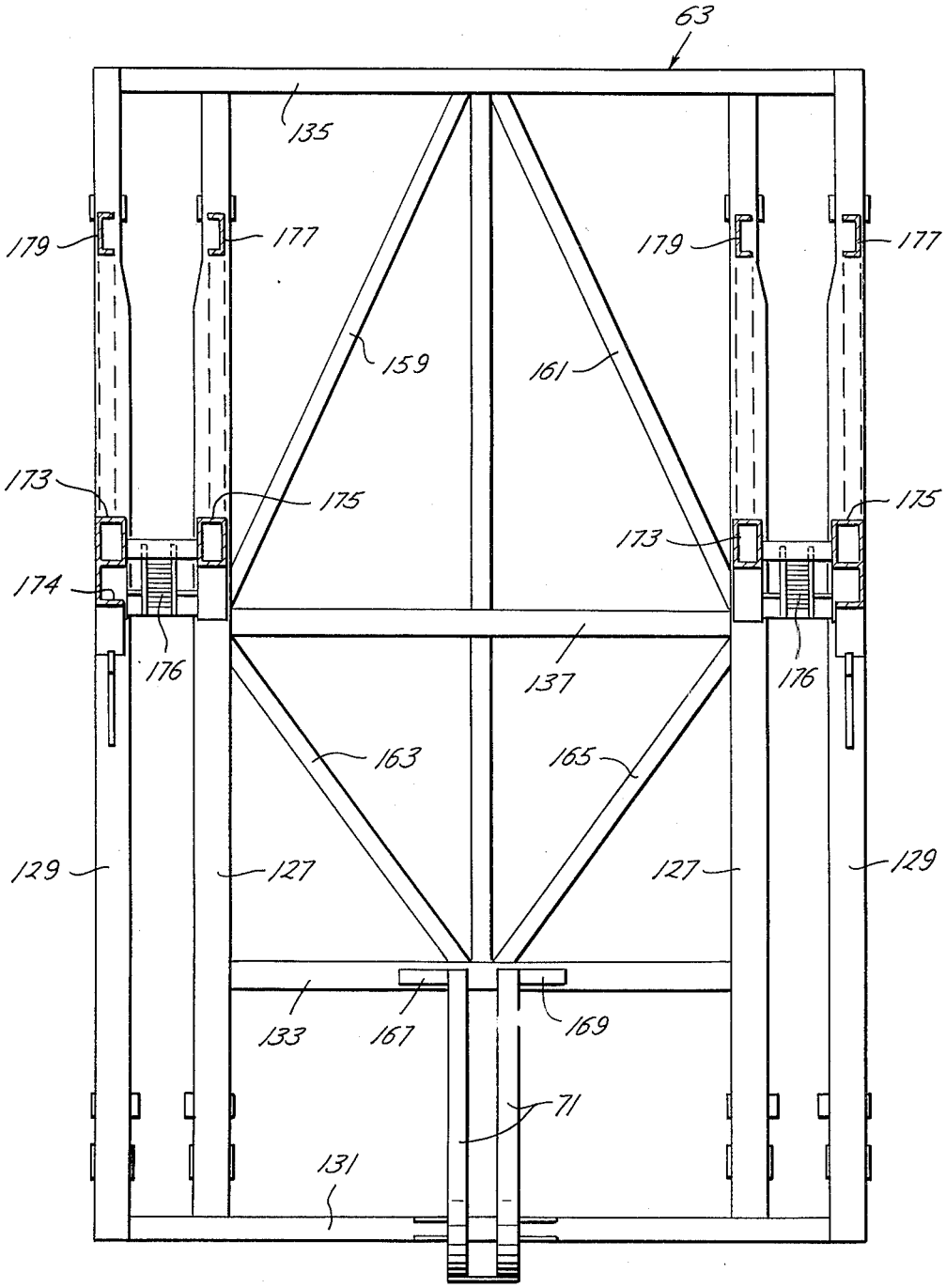
FIG. 13 is a plan view of the wheeled chassis of the car.

The lower leveling means, shown generally in FIG. 3 and 71, 73, includes the rollers 73, shown best in FIG. 11, carried by scaffold 51 engaging leveling tracks 71, shown in side elevation in FIG. 10 and in plan view in FIG. 13, mounted on chassis 63. Leveling track 71 includes facing channel guides, illustrated in FIG. 10A, for engaging dual rollers 73, like rollers 104 shown in FIG. 12, mounted at the pivotal connection 100 of links 101, 103. The level actuator is shown in plan view in FIG. 12 and includes a hand driven screw jack 109 mounted on scaffold 51 at 113 for causing rollers 73 to move within the leveling track 71. Rollers are moved through movement of rollers 104, mounted on a clevis threaded onto the end of the screw jack 109, within the guide channel 106, like those illustrated in FIG. 10A, affixed on the scaffold 51 parallel to the axis of the jack 109. The upper ends of links 101 are pivotally connected to the scaffold 51 at 105. FIG. 3 illustrates scaffold 51 located above springline 37 when the linkage 101, 103 and jack 109 are in the retracted position as shown in FIG. 11. If scaffold 51 was located below springline 37, the linkage and jack would be in the extended position as shown in broken lines in FIG. 11.

Referring again to FIG. 4, it will be seen that the axis of pivotal connections 85 of the line grippers 83 to the scaffold 51 is not coaxial with the axis at which car connectors 65 are pivotally connected at 115 to the scaffold 51, the axis at 85 being closer to the vertical axis of the dome 35 than the axis at 115. This creates torque on car 57 tending to lower its outer edge 117 and raise its inner edge 119. This torque, plus or minus any torque due to the location of the center of gravity of the scaffold 51, loaded and unloaded, is countered by the guide rollers 73 and leveling tracks 71, just described with reference to FIGS. 11 and 12.

Wheels 59, previously described, are positioned on car chassis 63 as best shown by FIGS. 3, 4, and 10. Referring now to FIGS. 18–21 for mounting details, at the upper end of the car 57, the wheels 59 are disposed between chassis beams 127, 129 in trucks 121 pivotally connected by shafts 122 to chassis beams 127, 129 at 123. The wheels 59 mounted at the lower end of chassis 63 are directly rotatably connected at 125 to beams 127, 129 by shaft 128.

Figure 14:
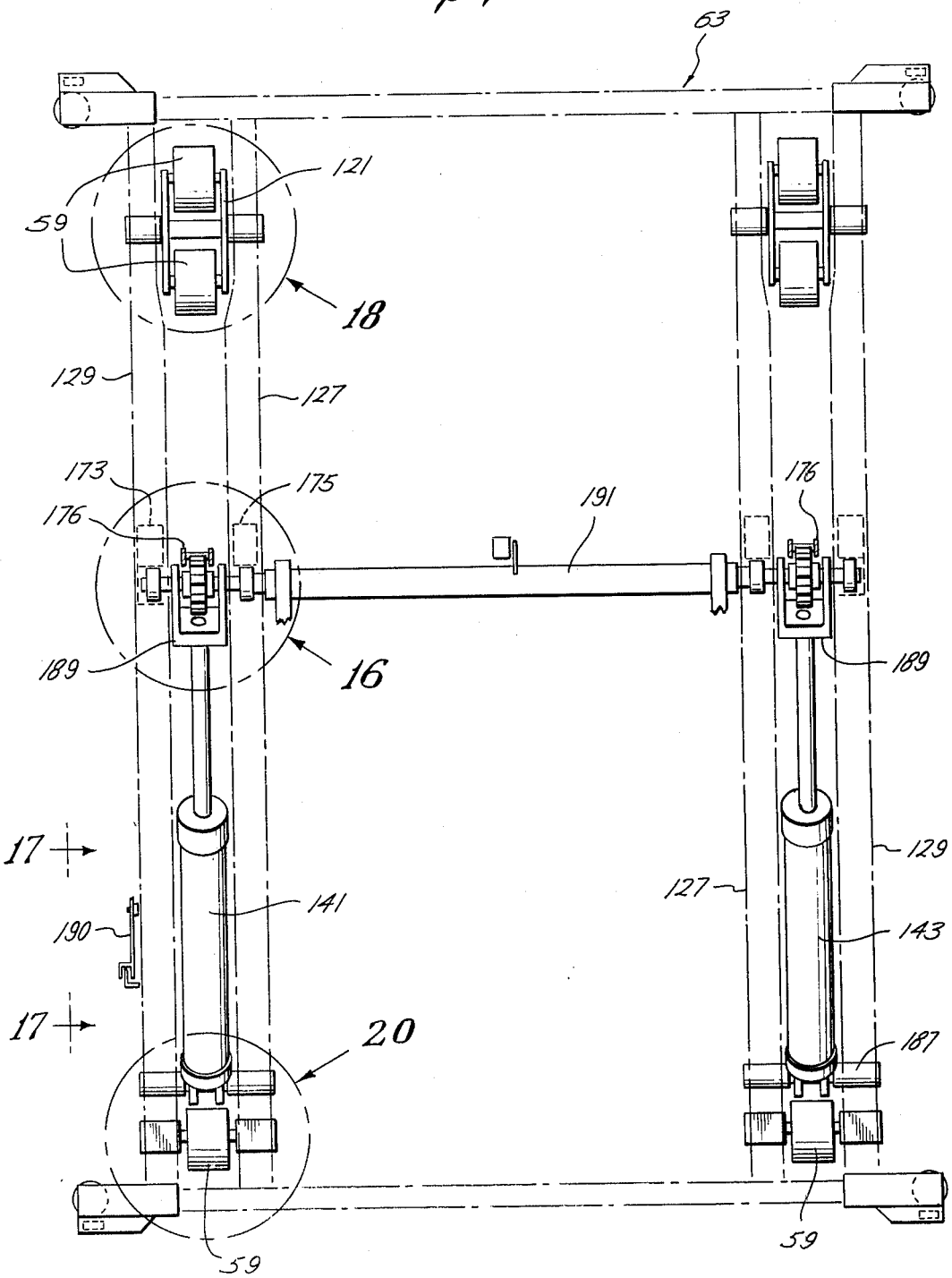
FIG. 14 is a fragmentary view similar to FIG. 13 but to a larger scale showing the upper part of the car chassis and hydraulic jack drive means mounted thereon.
Figure 15:
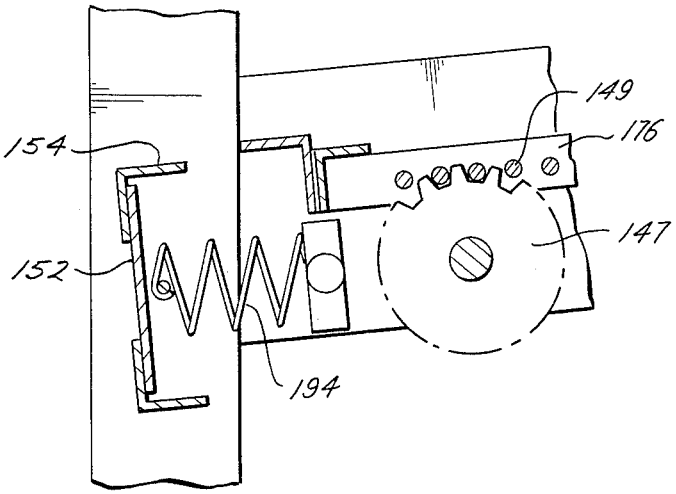
FIGS. 15 and 16 are sections taken at planes 15—15 of FIG. 10 and 16—16 of FIG. 14, FIG. 15 emphasizing the spring bias means for the pinion timing gear engaging the timing rack, and FIG. 16 emphasizing the hydraulic jack shaft, its attachment to the torque beam, and the torque beam's engagement with the support beams of the boom.

Referring now to FIGS. 13 and 14 there is shown car chassis 63 including inner and outer side beams 127, 129, cross beams 131, 133, 135, 137 to support identical hydraulic jacks 141, 143 shown in FIG. 14. The upper part of the chassis 63 is diagonally braced by beams 159, 161 and the middle part is diagonally braced by beams 163, 165. Guide tracks 71 are supported at their upper ends by braces 167, 169, connected to cross beam 133 (see also FIG. 10).

Referring now to FIGS. 10, 13, 14, 15, 16 and 17 for a complete description of the boom 61, inner and outer support beams 173, 175 extend from each side of the car chassis 63 from between chassis beams 127, 129 to which they are connected, out over the top of the scaffold 51. The cylinder timing rack 176 is positioned between and parallel to the axis of support beams 173, 175. Support beams 127, 129 and rack 176 are set at a slight angle so that the line of action of hydraulic jacks 141, 143 is tilted upwards slightly. This gives beams 127, 129 a slight batter to enable them to better withstand the downward component of the scaffold load. Pins 178 mounted on parallel side plates 180 form the cylinder timing rack 176 and the near side and far side timing racks 176 shown in FIGS. 13, 14 are adjustable to maintain the motion of the torque shaft 191 parallel to the plane of car chassis 63. At their outer ends, support beams 173, 175 are connected to brace beams 177, 179 which are connected to the car chassis 63 at their inner ends. The outer ends of the support and brace beams at the far side of the car are connected in the same manner as the outer ends of support beams 173, 175 and brace beams 177, 179 at the near side of the car just described. The outer ends of support beams 173, 175 and brace beams 177, 179 are covered by an end plate 181 shown in FIG. 10.

Figure 16:
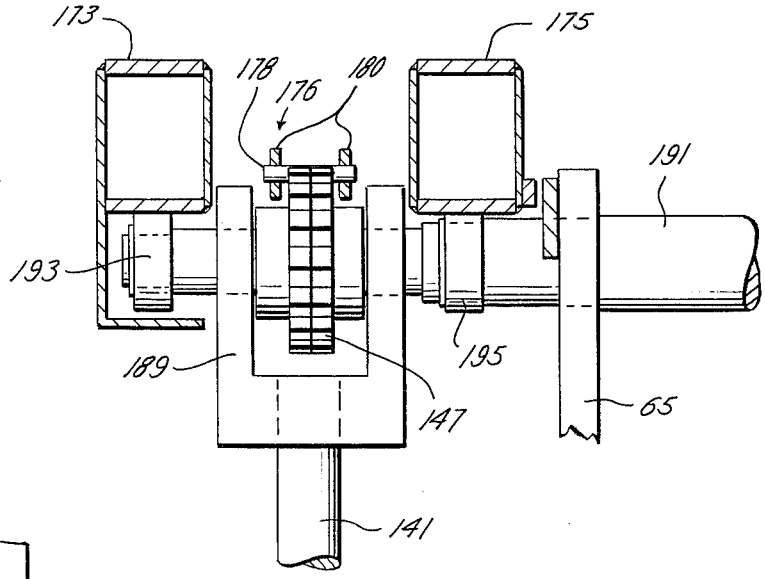
Figure 20:
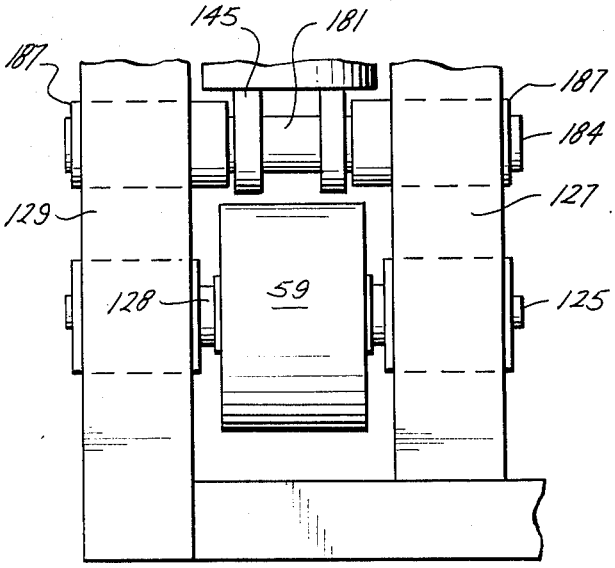
FIGS. 20 and 21 are sectional and elevational views taken at plane 19—19 of FIG. 14 showing the joints supporting the ends of the hydraulic jack and the lower wheel mountings on the car chassis.
Figure 21:
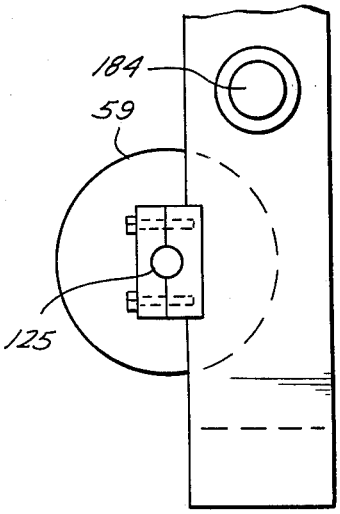

Referring now to FIGS. 15 through 20, hydraulic jacks 141, 143, e.g. Milwaukee Cylinder Jacks—Model #H61, located at the near side and far side of the car 57 are connected to car 57 at their inner end by a cylinder clevis 145 as shown in FIG. 20. Pin 184 passes through beams 127, 129 of the car chassis 63 at the clevis 145 of hydraulic jacks 141, 143 to create joints 187. Pinion timing gear 147, shown on FIG. 16, is rotatably mounted on a clevis 189 threaded on the outer end of hydraulic jacks 141 and is adapted for engagement with cylinder timing racks 176. Pinion timing gears 147 assure precise timing and coordination of the movement of hydraulic cylinder rods 142. The outer ends of torque shaft 191 pass through the clevis mounts 189 on the end of the hydraulic jacks 141, 143 to connect the clevises in tandem, and through gears 147 to provide a rotatable attachment. On the extreme outer ends of torque shaft 191 are mounted bearings 193, enclosed by the channel 174 formed by support beam 173 to restrain bearings 193 in the event of a temporary reversal of forces from rods 142, and engageable with support beam 129 guiding the movement of torque beam 191 and restraining vertical forces as it moves in and out relative to boom 61. Such movement is caused by the rotatable engagement between the sprockets of gears 147 and the pins of cylinder timing racks 176 as hydraulic jacks 141, 143 are simultaneously expanded and contracted. Bearing assemblies 195 are mounted on torque beam 191 just interior to the clevis 189 for engagement with suport beams 175 as torque beam 191 moves relative to boom 61. Hanger plates or connectors 65 are mounted on torque beam 191 for pivotally supporting scaffold 51 at connections 115.

Bias means such as spring 197 is mounted on plate 152 between beams 127, 129 on angle irons 154 to serve as a cushion and a limit of travel for pinion timing gears 147. Bias means 197 also provides an additional lateral force on gears 147 when hydraulic jacks 141, 143 are close to a dead center position, i.e. fully retracted.

Dual identical hydraulic jacks are provided as a safety feature. If one of the hydraulic jacks 141, 143 should fail, the other will fully support the load which is transmitted in torsion through torque beam 191 permitting scaffold 51 to be lowered in a safe, controlled manner. Hydraulic cylinder jacks 141, 143 may be operated by any conventional hydraulic control system which can apply hydraulic actuator fluid to the jack cylinders for extending or retracting rods 142. Overcenter valves, not shown, are mounted on jacks 141, 143 to serve as safety check valves maintaining pressure in the cylinders in the event of failure of hydraulic hoses or other hydraulic components.

Figure 17:
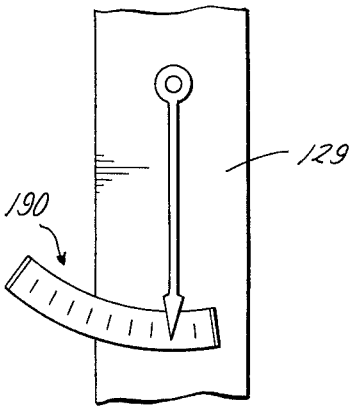
FIG. 17 is a plan view of the pendulum attitude indicators.
Figure 18:
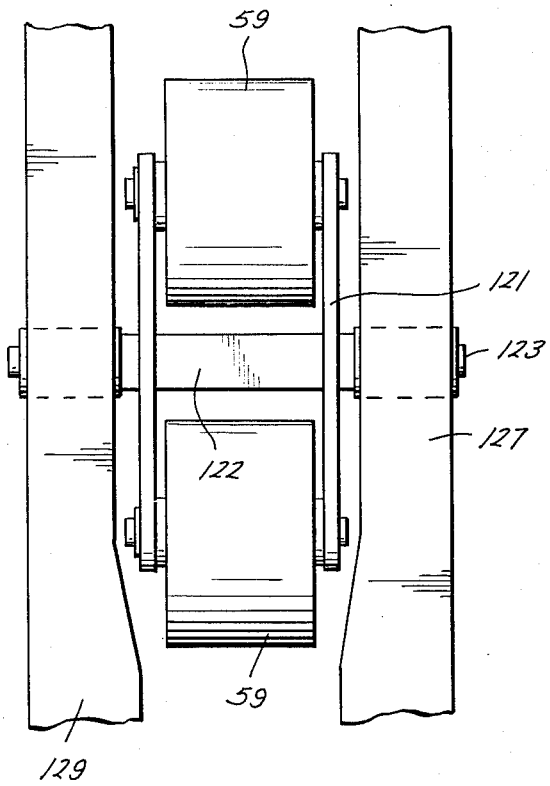
FIGS. 18 and 19 are plan and side views of the sections taken at plane 18—18 of FIG. 14 showing the wheel mountings on the car chassis.
Figure 19:
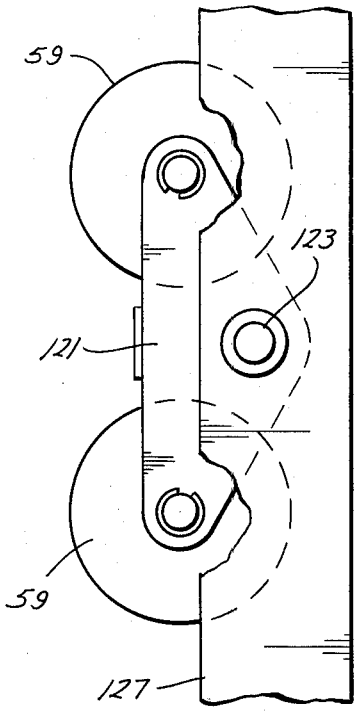

A gravity type pendulum angle indicator 190, as shown in FIG. 17, is mounted on the lower portion of beam 129 of car chassis 63. The indicator 190 records the angle in one degree increments of the car chassis 63 with respect to vertical.

The scaffold apparatus 51 operates in the following manner. When below the springline 37, the scaffold 51 is in a position such as shown in FIG. 4. The upper end of the scaffold 51 is supported at 85 and 115 by the line climbers 83 and connectors 65, and the lower end of the scaffold is supported by the rollers 73 on the scaffold 51 engaging tracks 71 on the car 57. When the scaffold 51 moves above the springline 37, as shown in FIG. 3, connector 65 is moved out away from dome surface 53 by torque beam 191, thereby providing enough room for the scaffold 51 to hang vertically from line climbers 83 and connectors 65 and be kept level by rollers 73 and tracks 71.

In an alternative embodiment, screw jacks replace hydraulic jacks 141, 143 and timing racks 176. The screw jacks are disposed between and connected at their inner ends to beams 173, 175 and are connected at their outer ends to beams 177, 179 by end plates 181. The screw jacks have threaded shafts connected to the end plates 181 by ball joints. Threaded nuts are disposed on the ends of torque beam 191 and threadingly engage the threaded shafts of the screw jacks. As the shafts of the screw jacks rotate, the torque beam 191 is moved in and out relative to the boom 61. A flexible, chain-link type, cable housing is provided below torque beam 191 and end plate 181 to power an electric motor on the car for driving the screw jacks.

Figure 22:
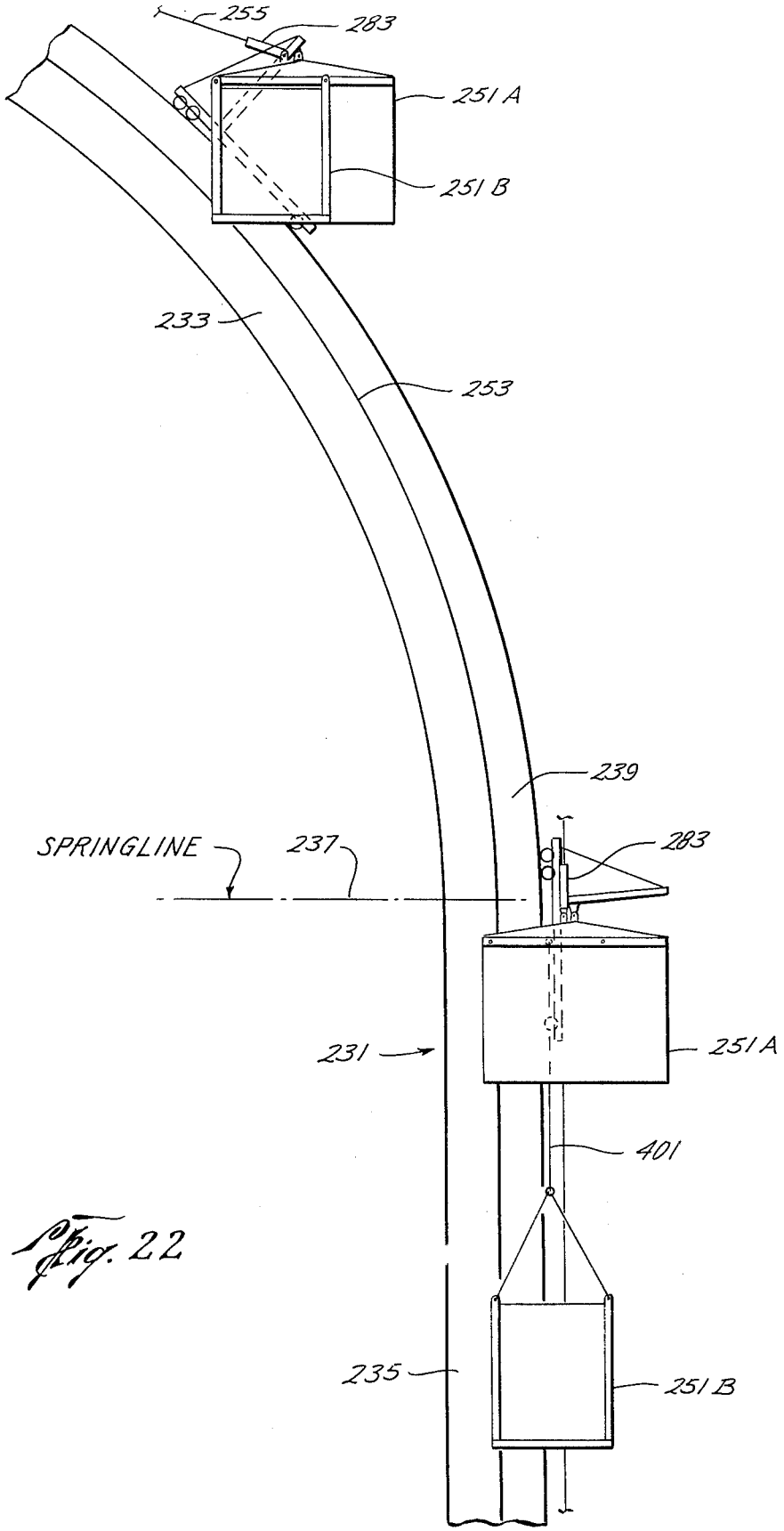
FIG. 22 is a schematic side elevation similar to FIG. 1 but illustrating a modified form of the invention, the upper part of FIG. 22 showing the scaffold in operation over the dome with its pup scaffolds docked in the main scaffold and the lower part of FIG. 22 showing the scaffold in operation over the side of the structure with the main scaffold just below the springline and the pup scaffolds depending from the main scaffold.

Referring now to FIGS. 22 through 27 there is shown a modification of the invention. Parts which are the same as in the first described embodiment are given the same number plus two hundred, and need not be redescribed in detail. The differences will be pointed out. In the modification, the scaffold 251 includes a docking module or main scaffold 251A and two pup scaffolds 251B and 251C. As shown in FIG. 22, when the scaffold 251A is above the springline 237, the pup scaffolds 251B, 251C are docked in the docking module 251A. When it is desired to operate below the springline 237, the pups 251B, 251C may be left docked in the docking module 251A and the scaffold 251A operated as in the first embodiment, or the pup scaffolds 251B, 251C may be removed from the docking module 251A and suspended therebelow. Then the pup scaffolds 251B, 251C can be positioned at the desired working level by raising and lowering the main scaffold 251A which is kept near the springline 237.

Figure 23:
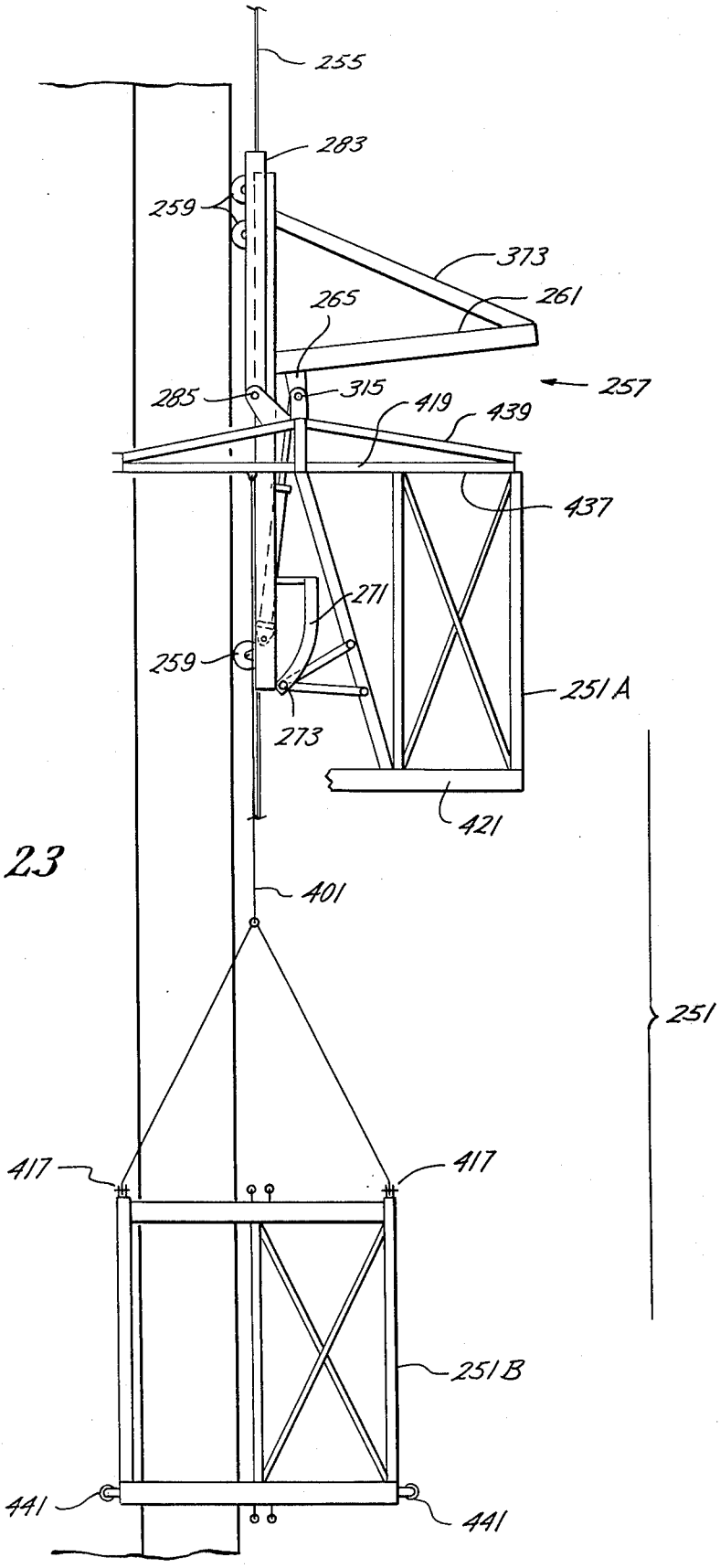
FIG. 23 is a side elevation similar to the lower part of FIG. 22 but to a larger scale.

As shown in FIG. 23, scaffold 251A is suspended and supported the same as in the first described embodiment of the invention. The scaffold 251A is provided with line climbers 283 which engage line 255. Line climbers 283 are pivotally connected to the top of the docking module 251A at 285. Connector 265 carried by boom 261 of wheeled car 257 is pivotally connected to the docking module 251A at 315. Adjustably mounted rollers 273 carried by module 251A cooperate with track 271 on the car 257 to keep the module 251A level.

Figure 24:
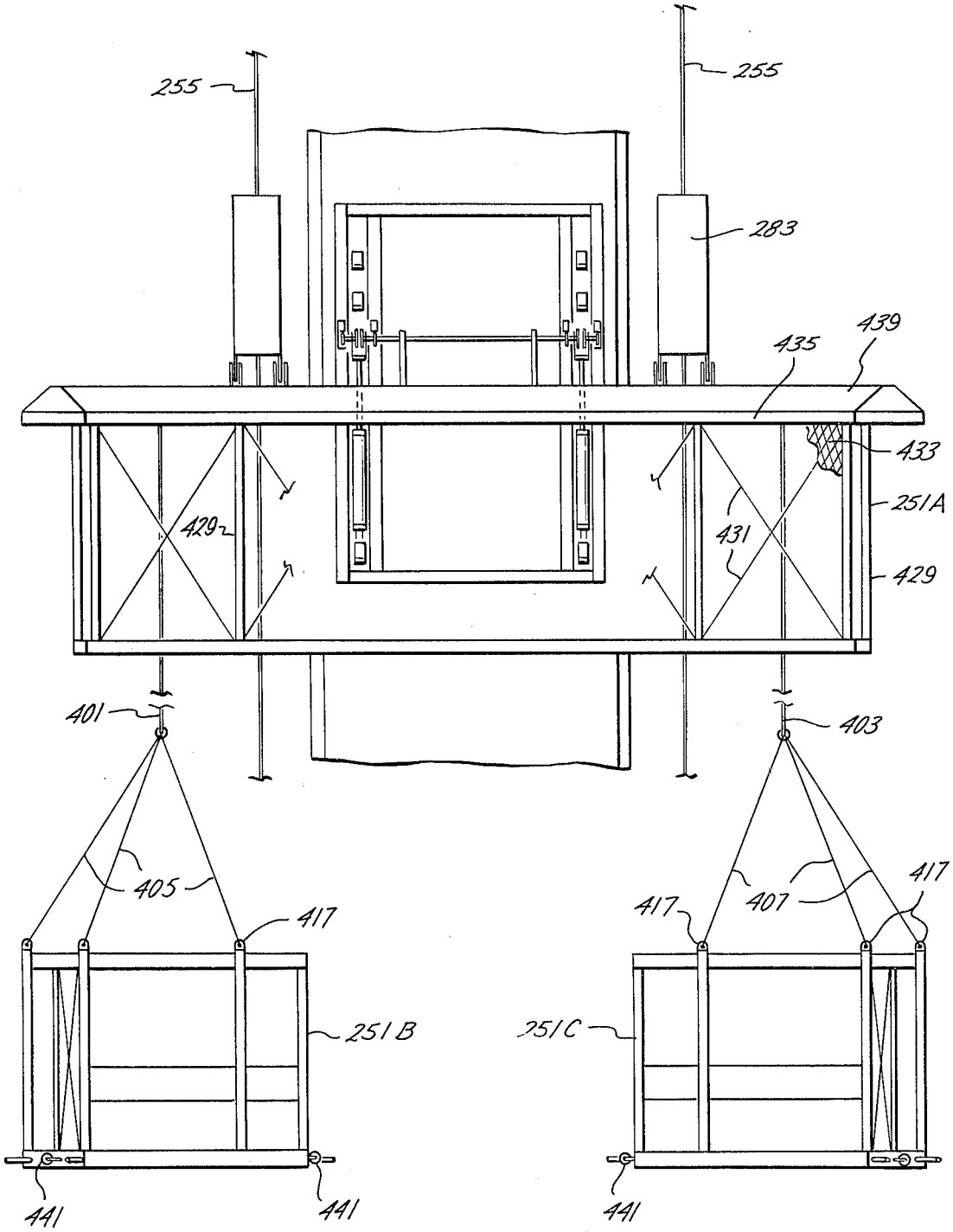
FIG. 24 is a front view of the subject matter of FIG. 23.
Figure 25:
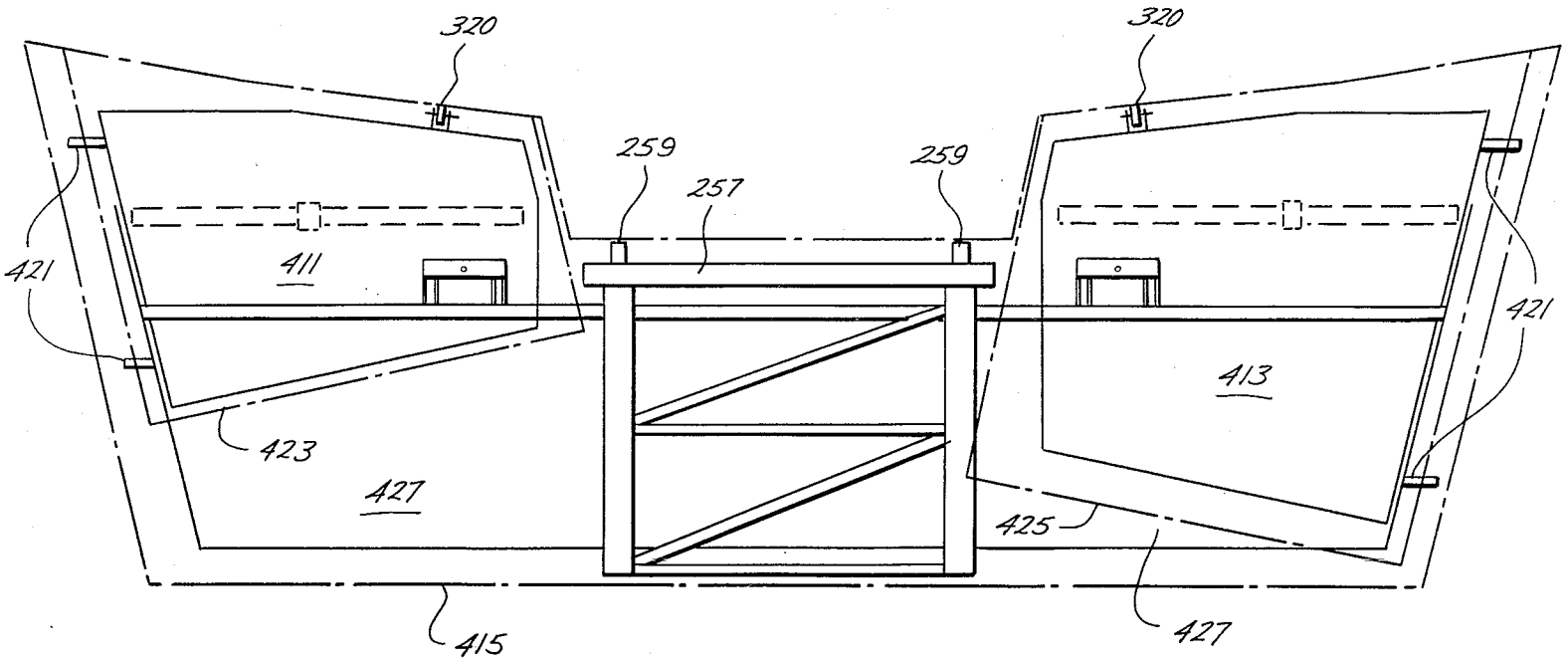
FIG. 25 is a plan view of the main scaffold shown in FIG. 23.

Referring now especially to FIGS. 24 and 25 pup scaffolds 251B, 251C are suspended from the docking module 251A by flexible lines 401, 403. Each pup scaffold 251B, 251C is connected to the lower end of its suspension line, 401 or 403, by a plurality of sling lines 405, 407. The upper ends of suspension lines 401, 403 are connected to the docking module 251A.

When the pup scaffolds 251B, 251C are docked they fit into the spaces such as 411, 413, shown in FIG. 25, in the docking module 251A, the spaces being of different sizes to accommodate different shapes of pup scaffolds 251B, 251C as required to fit different openings into which they may be lowered. Pup scaffolds 251B, 251C are sized to use all of the available space in module 251A which will permit pup scaffolds to fit within the docking module 251A.

As an example of the operation of the embodiment shown in FIGS. 22–25, at a station 304 degrees about the dome axis, measured from a fixed reference, the pup scaffolds 251B, 251C remain connected to the docking module at all times, the whole scaffold including both the docking module and the pup scaffolds passing through the floor openings whose perimeter is indicated on FIG. 25 at 415. During such operation the pup scaffolds 251B, 251C are connected to the docking module 251A by pins placed through eyes 417 (FIGS. 23, 24) in the tops of the pup scaffolds 251B, 251C and registering openings (not shown) in top beams 419 of the docking module 251A.

On the other hand, at the 64 degree station, the pup scaffolds 251B, 251C are docked in the docking module 251A and pinned thereto for operation above the 119 foot level. At level 119 feet temporary support tubes 421 (FIG. 25) are extended to rest upon an adjacent support frame provided on an auxiliary building (not shown) rising to that level. Then the pins connecting the pup scaffolds 251B, 251C to the docking module 251A are removed and the docking module 251A and car 257 are raised to about 20 degrees above the springline 237. Sling sleeves 405, 407 are then connected to the pup scaffolds 251B, 251C and the suspension lines 401, 403 are connected between the slings and the docking modules. The support tubes are retracted and the pup scaffolds are then lowered into holes, at either side of the buttress, whose perimeters are indicated at 423, 425 in FIG. 25, by lowering the docking module 251A and car 257. At elevation 54 feet, the support tubes 421 are again extended, lines 401, 403 are disconnected from the docking module 251A, the module 251A and car 257 are elevated to 20 degrees above the springline 237, and additional lengths of suspension lines 401, 403 are added and connected to the docking module 251A. The module is then lowered to lower the pup scaffolds 251B, 251C, which can be lowered to elevation minus eleven feet. The reverse procedure is used to raise the pup scaffolds 251B, 251C and redock them.

In both the first described embodiment and the modification past described, the scaffold 51, 251 may be constructed in any desired manner. As shown in FIGS. 23–25, the docking module or main scaffold 251A includes a plurality of longitudinal and transverse beams 425 which support a plate flooring 427 and studs 429. Diagonal braces 431 extend between the studs, and a metal grille 433 encloses the scaffold 251A. The tops of the studs are connected by beams 435, 437 and the top is covered by roof 439. The scaffold 51 at the first described embodiment is similarly constructed, as are the pup scaffolds 251B, 251C of the modification.

The pup scaffolds 251B, 251C are provided with guide rollers 441 on their sides to facilitate their docking and undocking motions relative to the docking module 251A.

While preferred embodiments of the invention have been shown and described, further modifications thereof can be made by one skilled in the art without departing from the spirit of the invention.

We claim:

1. Scaffold apparatus comprising a car adapted to move over a surface curved in elevation;

positionable means adapted to be positioned relative to such surface;

said positionable means including connector means for use in making a pivotal connection to a scaffold, support means movably mounting the connector means on the car, thrust means for moving the connector means relative to the car;

said car including a chassis carrying rotatable means to support the car on such surface and a boom extending transversely to the chassis providing said support means for the connector means; and said boom including a pair of racks each connected at one end to the chassis and a cross member reciprocably movable on said racks, said connector means including a pair of hangers positioned on said cross member.

2. Apparatus according to claim 1, said thrust means comprising a hydraulic jack, said support means including guide means for said connector means.

3. Apparatus according to claim 1, said thrust means comprising gear means adapted for engaging said racks and hydraulic jack means for moving said gear means.

4. Apparatus according to claim 3, said gear means comprising a pair of gears rotatably disposed on said cross member, said gears engaging said racks to move the cross member in and out relative to the chassis as the gears are rotated in one direction and the other by said hydraulic jack means.

5. Apparatus according to claim 4, said boom including means for limiting the travel of said gears on said racks.

6. Scaffold apparatus comprising a car adapted to move over a surface curved in elevation, positionable means adapted to be positioned relative to such surface, said positionable means including connector means for use in making a pivotal connection to a scaffold, support means movably mounting the connector means on the car, thrust means for moving the connector means relative to the car, and said car including first guide means cooperable with second guide means on a scaffold to level such scaffold when pivotally connected to said connection means.

7. Scaffold apparatus comprising a car adapted to move over a surface curved in elevation, positionable means adapted to be positioned relative to such surface, said positionable means including connector means for use in making a pivotal connection to a scaffold, support means movably mounting the connector means on the car, thrust means for moving the connector means relative to the car, said positionable means including a scaffold pivotally connected to said connector means, and the pivot axis of said connector means being located at a distance from the point of suspension of said scaffold, said car and said scaffold including cooperable guide means for leveling the scaffold.

8. Apparatus according to claim 7, said scaffold including an upper portion and a lower portion, said connector pivotally connecting the car to the upper portion of the scaffold and said cooperable guide means acting on the lower portion of the scaffold.

9. Scaffold apparatus comprising a car adapted to move over a surface curved in elevation, positionable means adapted to be positioned relative to such surface, said positionable means including connector means for use in making a pivotal connection to a scaffold, support means movably mounting the connector means on the car, thrust means for moving the connector means relative to the car, said positionable means including a scaffold pivotally connected to said connector means, and said car and said scaffold including cooperable guide means for leveling the scaffold.

10. Apparatus according to claim 9, said car including rotatable means to support said car on said surface, said scaffold including line climbing means adapted to engage flexible line means for suspending the scaffold and pressing said rotatable means against the surface.

11. Apparatus according to claim 9, said cooperable guide means including a track connected to said car, a roller movable in said track, linkage connecting said roller to said scaffold, and jack means for adjusting the position of said linkage.

12. Scaffold apparatus comprising a car adapted to move over a surface curved in elevation, positionable means adapted to be positioned relative to such surface, said positionable means including connector means for use in making a pivotal connection to a scaffold, support means movably mounting the connector means on the car, thrust means for moving the connector means relative to the car, said positionable means including a scaffold pivotally connected to said connector means, and said scaffold having an inset in its perimeter adapting the scaffold to fit around a buttress on such curved surface, said car being received in said inset.

13. Apparatus according to claim 12, said car including a chassis nested in said inset and a boom extending transversely from said chassis over the top of said scaffold, said support means being carried by the boom.

14. Apparatus according to claim 12, said scaffold including rotatable means for engaging such surface at either side of such buttress and said car including rotatable means for engaging the sides of such buttress.

15. Apparatus according to claim 12, said scaffold including rotatable means for engaging such surface at either side of such buttress, said car including at each side of the car rollers mounted thereon for engaging vertically extending mutually perpendicular surfaces removably secured to the sides of such buttress where the buttress continues along a vertical continuation of such curved surface.

16. Apparatus according to claim 12, said scaffold including rotatable means for engaging such surface at either side of such buttress, said scaffold further including docking stations at each side of buttress with pup scaffold means connected to the first said scaffold and adapted to be moved into and out of said docking stations.

17. Apparatus according to claim 16, said pup scaffold means being provided with eyes by which it can be pinned to the first said scaffold or suspended therefrom with wire lines and with support tubes by which it can be supported from adjacent structure.

18. Apparatus according to claim 12, in combination with a structure providing such surface and a plurality of lines connected to said structure at a top portion of said surface extending down through line climbing means included in said scaffold, said structure further providing a second surface that is straight in elevation which extends below the first said surface, and said structure including such buttress extending vertically along said second surface and thence upwardly along said curved surface, said buttress having perpendicular extensions along each side engageable with outriggers carrying rotatable means on said car on opposite sides thereof.

* * * * *